United States Patent [19]

Smith et al.

[11] Patent Number: 4,783,917

[45] Date of Patent: Nov. 15, 1988

[54] WRIST BAND

[75] Inventors: Robert E. Smith, 172 Sunset, Glen Ellyn, Ill. 60137; Thomas A. Johnson, Jr., Carol Stream, Ill.

[73] Assignee: Robert E. Smith, Glen Ellyn, Ill.

[21] Appl. No.: 16,853

[22] Filed: Feb. 20, 1987

[51] Int. Cl.[4] ..... G09F 3/14

[52] U.S. Cl. ..... 40/633

[58] Field of Search ..... 40/21 R, 21 C, 2 R; 434/410; 428/29, 915, 916

[56] References Cited

U.S. PATENT DOCUMENTS

| | | | |
|---|---|---|---|
| 2,697,884 | 12/1954 | Dechert | 434/410 |
| 3,059,359 | 10/1962 | Goldammer et al. | 40/21 C |
| 3,153,869 | 10/1964 | Twentier | 40/21 C |
| 4,221,063 | 9/1980 | Charles et al. | 40/21 C |
| 4,233,715 | 11/1980 | McDermott | 40/21 C |
| 4,311,740 | 1/1982 | Kay | 40/21 C |
| 4,318,234 | 3/1982 | Charles et al. | 40/21 C |

FOREIGN PATENT DOCUMENTS

| | | | |
|---|---|---|---|
| 343742 | 2/1931 | United Kingdom | 434/10 |

*Primary Examiner*—Gene Mancene
*Assistant Examiner*—Michael Lynch
*Attorney, Agent, or Firm*—Alan B. Samlan

[57] ABSTRACT

A bracelet assembly for carrying identification information. The bracelet assembly has an elongated flexible band with fastening means for fastening the band in a closed loop fashion around a patient's limb. There is a transparent portion on the flexible band through which the user can read the identification information. A permanently deformable layer is interposed between the transparent portion and a base layer. The base layer and permanently deformable layer are of contrasting colors. The permanently deformable layer is deformed by lines of force applied by mechanical pressure means such as a typewriter or credit card imprinter which deforms the deformable layer along the lines of force which correspond to the identification information. This renders the base layer visible through both the transparent portion and the permanently deformable layer along the lines of pressure.

8 Claims, 1 Drawing Sheet

WRIST BAND

BACKGROUND AND SUMMARY OF THE INVENTION

This invention relates to an identification system and more particularly to a bracket identification system in which the readable patient information is permanently contained within the bracelet. Identification bracelets of this type are used primarily for identifying patients in hospitals, rehabilitation centers and rest homes.

In today's hospitals each patient is customarily given an identification bracelet containing his or her name and other relevant information. The patient is also given a plastic card, similar to a credit or charge card, having the same information embossed in the card. The card is unique to that patient and can be processed through standardly available credit card imprinters. Thus, information from the patient's individual card can be transferred to individual charge slips for services or supplies given to that patient. Applicant has incorporated this card system into an identification bracelet system in which the patient's information is transferred from his or her embossed card to an identification bracelet.

In addition to having the patient identification information on the bracelet, the bracelet itself must not be easily removed. This is especially important for security reasons and to minimize the possibility of one patient receiving medication intended for another patient. Thus, the band should only be removed in an authorized manner which will substantially destroy the band and prohibit its reuse.

In the past most identification bracelets were made of a plastic type material which was looped around the patient's limb and fastened. The identification information is written, typewritten or imprinted on a paper or similar receiving medium which is affixed to the bracelet or the plastic bond material itself before the bracelet is placed on the patient. A major problem with this type of bracelet is that the identification information is generally printed with ink which can be rubbed, smudged and possibly washed off. Hydrotherapy, showering or washing one's hands tended to remove the patient information from the bracelet. These type of bracelets are generally inadequate for hospital use in which the patient identification must be legibly and permanently affixed to the patient's wrist until such time as it is intended to be removed.

One example of a bracelet identification system is illustrated in U.S. Pat. No. 3,751,835 entitled Identification System. This system included a label system in which a series of labels are retained in a bracelet and can be individually removed for use by hospital staff. This system does not have the patient information imbedded within the bracelet and the labels can be damaged by moisture. Another example of a bracelet is illustrated in U.S. Pat. No. 4,226,036. This device has the identification information on a tag that is attached to the bracelet by a tether. A shortcoming of this bracelet is that it is expensive to manufacture and it is bulkier and thicker than can be comfortably worn by a patient.

Examples of recording materials are shown in U.S. Pat. Nos. 2,670,971 entitled Flexible Record Protective Recording Media and 2,648,924 entitled Label Structure. The '971 disclosure relates to a flexible recording media which utilizes a carbon transfer to create the image. The label shown in the '924 patent does not suggest its use in a bracelet assembly. Furthermore, it uses a waxy material sealed within the label structure. When the wax is moved, a readable image is created. A shortcoming is if the seal should rupture, the wax would escape and the image ruined. Also, the wax could be moved subsequent to the creation of the image, which would result in the loss or destruction of the information on the label.

A solution to the above problem is to have an identification bracelet in which the information is permanently embedded in the bracelet in such a manner that it is impervious to the surrounding elements. As stated above, a major problem with the prior art devices is that the identification is either written on the outside of the bracelet, is not permanent, or it is contained on a piece of paper which is embedded in a pocket or pouch on the bracelet. The use of pockets is generally unacceptable as they are not water-tight and, therefore, are not impervious to the introduction of water or bodily fluids which can destroy the paper and printed information.

Applicant's invention provides for the readable patient information being permanently contained within the band rather than on an exterior surface of the band. Thus, the information is completely protected from exposure to bodily fluids or other external chemicals which may denigrate the readability of the patient information. Furthermore, in the preferred embodiment, the readability of the patient information is of superior quality as it is generally printed with a credit card imprinter, a typewriter or other similar printing device. This is an important feature in that critical information relevant to each patient will not be inadvertently misinterpreted or misread.

Applicant's invention is an identification band made of flexible plastic that is looped around a patient's limb and the fastened by means of a locking fastener. There is a transparent portion through which the patient identifying information is viewed. Beneath each transparent portion is a layer of permanently deformable polytetraflourethylene. Beneath this layer is a base layer of contrasting colored material. When concentrated pressure is applied from an embossed plastic card, which is inserted within an imprinter, the imprinting force pushes the contrasting base material through the polytetraflourethylene layer which creates a readable image through the transparent portion of the identification bracelet. The concentrated pressure can also be applied from the top of the band on the protective cover which deforms the polytetraflourethylene material and exposes the contrasting base material along the lines of force created by the concentrated pressure.

Polytetraflourethylene is a permanently deformable type material which once altered through concentrated pressure applied agaist a rigid surface retains the deformation. The band with the patient information embossed thereon is affixed to the patient's limb with a non-removable fastener. The band is highly flexible as it is manufactured from a lamination of nylon and low density polyethylene. The readable information is impervious to moisture and body fluids as the information is completely sealed within the band.

Thus, it is an object of the present invention to provide a bracelet assembly which carries identification information on an elongated flexible band with the identification information embedded within the band. Related to this object is the object of providing a bracelet assembly which has the identification information impervious to body fluids, moisture, dirt, and abrasion.

Another object is to provide a bracelet assembly which has the identification information transmitted from a plastic card and associated plastic card imprinter onto the bracelet assembly.

Another object is to provide a bracelet assembly which has a polytetraflourethylene layer of material which is permanently deformed by the application of mechanical pressure to render a visible image through the bracelet.

Another object is to provide a bracelet assembly which can be locked around a patient's limb and not easily removed without destroying the bracelet assembly. Related thereto is the object of providing a bracelet assembly that will not easily allow the modification of information on the bracelet while the bracelet is being worn.

Yet another object is to provide a bracelet assembly which can have identification information written on the front surface of a bracelet assembly which deforms the deformable layer leaving a readable image within the bracelet assembly. Related to this object is the object of having identification information embedded into the deformable layer by means of a typewriter without the need of the inked image remaining on the identification bracelet.

Yet another object is to provide a bracelet assembly in which identification information is embedded in a bracelet without the need of inks or chemicals to form the readable information.

These and other objects will become apparent upon reading the brief description of the drawings and the detailed description of the preferred embodiment.

DESCRIPTION OF THE PREFERRED EMBODIMENT

Figure 1:
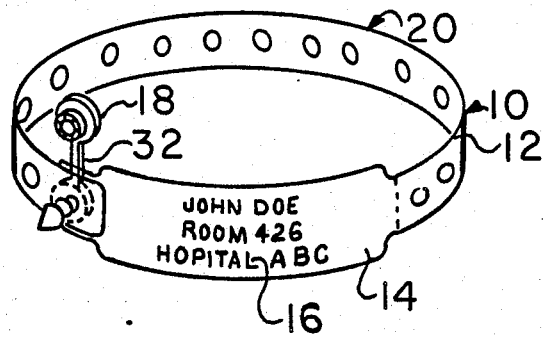
FIG. 1 is a perspective view of the identification bracelet assembly closed in a loop fashion and locked with a fastener.
Figure 4:
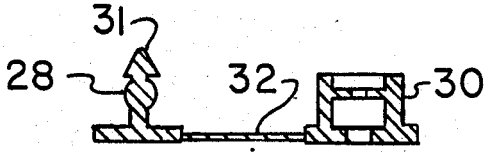
FIG. 4 is a cross-sectional view of the locking fastener.

Turning first to FIG. 1 there is illustrated a bracelet assembly 10 of the present invention. An elongated flexible band 12 extends the length of the assembly 10. There is a transparent portion 14 through which one can read identification information 16 relating to a particular patient. Generally the identification information is information unique to one particular person and may include a patient's room number, hospital name, doctor's name, account number, etc. This information is given to the patient on an embossed plastic card similar to a credit card. The bracelet assembly 10 is looped around a patient's wrist and is fastened by means of a fastener assembly 18 which will be more fully described later.

Figure 2:
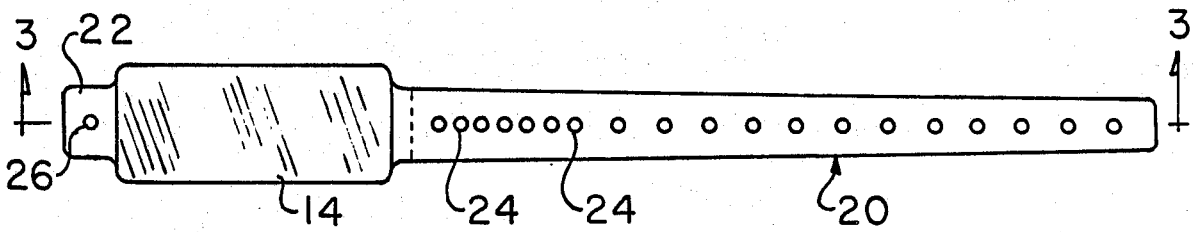
FIG. 2 is a top plan view of the bracelet assembly in its open position.

As seen in FIG. 2, the elongated flexible band 12 has a strap 20 at one end with the transparent portion 14 being at the other end. At the outer end of the transparent portion (the end opposite the strap 20) is a fastening tap 22. There are a plurality of holes 24 in the strap 20 and a fastening hole 26 in the fastening tab 22. When the strap 20 is snugly wrapped around the patient's wrist or limb, one of the holes 24 comes into alignment with the fastening hole 26. The fastener assembly 18 is placed through the aligned holes to securely lock the bracelet assembly 10 around the patient's limb. The fastener assembly 18 is comprised of a male plug assembly 28 which is placed into a female socket assembly 30 in a locking relationship. The male plug assembly is designed with a barbed end 31 that is lockingly received by the female socket assembly. The male and female ends are connected together by means of a tether 32. The tether 32 assists in keeping the male and female pieces together in pairs for user convenience.

Figure 3:
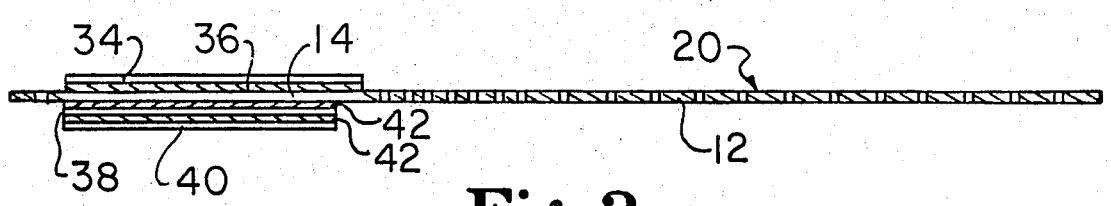
FIG. 3 is a cross-sectional view with portions enlarged for clarity taken along line 3—3 of FIG. 2 illustrating the various layers of the bracelet assembly.

FIG. 3 most clearly illustrates the several layers of the bracelet assembly 10. The transparent portion 14 is covered by a protective cover layer 34 which is affixed by a pressure-sensitive adhesive 36. The protective layer 34 is designed so that it can be written upon and subsequently removed. It can be made of paper or other inexpensive material as it is intended to be discarded. Beneath the transparent portion 14 is a deformable colored layer 38 made of polytetrafluoroethylene (PTFE) commonly sold under the name Teflon. PTFE is a nonmemory material which when deformed by pressure retains a deformed configuration corresponding to the lines of force that caused the deformation. The means is to deform the layer 38 can be a writing stylist such as a pen or pencil, a typewriter, or a plastic credit card imprinter. It is only necessary that the means to apply the writing pressure to the layer 38 supplies a concentrated pressure that will deform the layer 38. It is not necessary to use inks or chemicals to create a readable image.

Beneath the deformable colored layer 38 is a color contrasting base layer 40. This contrasting flexible base material may be polyethylene or similar material and of a color that contrasts with the color of layer 38. The colored layer 38 and color contrasting base layer 40 are affixed to each other and to the transparent portion 14 by means of adhesive layers 42. The adhesive may be a cold glue, heat activated adhesive, or other type of adhesive that will securely bond the layers to the adjacent layers in their appropriate position.

In the preferred embodiment, the bracelet assembly 10 is placed with the individual patient's plastic credit card into a credit card imprinter. The card imprinter is activated and the concentrated pressure from the plastic card forces the raised information on the embossed credit card into the contrasting base layer 40 and through the contrasting deformable colored layer 38. The PTFE deforms, exposing the base layer 40, resulting in a highly visible and readable image corresponding to the raiseed information on the credit card through the transparent portion 14 of the elongated flexible band 12. The protective layer 34 is peeled away from the transparent portion 14 as any inking indicia of the identifying information is not necessary to create the reader usable image. The patient identifying information can be viewed directly through the transparent portion 14.

Concentrated pressure can also be applied from the top of the band onto the protective cover layer 34 by means of a writing stylist such as a ballpoint pen or pencil. Similarly, a typewriter can be used. In both of these instances, the protective cover layer 34 is removed so that the readable patient identifying information can be read through the transparent portion 14. The pressure applied by the writing stylist or typewriter must be sufficient to deform the colored layer 38 so that the color contrasting base layer 40 can be viewed. The deformable color layer 38 only deforms in areas of concentrated pressure which correspond to the letters or other indicia which form the particular identifiying information for that patient.

The deformable colored layer 38 retains the deformed configuration after the concentrated pressure applying means are removed. The elongated flexible band 12 is highly flexible and may be clear or colored for special coding. The flexible band 12 may be fabricated of single or multiple laminated materials such as nylon, low density polyethylene, or the like. The materials chosen should be relatively soft against a person's skin, yet strong enough so that they will not easily be broken. The protective cover layer 34 is generally manufactured from paper of other similar materials as they will receive unusable inked information which is subsequently removed from the band and discarded.

All of the materials should be manufactured from a water and chemical resistant material suitable for hospital use. The bracelet thus can be easily wiped clean without in any way denigrating the patient identification information that is completely contained within the transparent portion 14. It can readily be appreciated that since the patient identification information is within the bracelet assembly 10 and is not written on the surface of the bracelet 10, the information is impervious to oil, water, body fluids, external dirt, and other contaminants that a person may come in contact with in a hospital environment. Furthermore, the image created by the credit card imprinter is sharp and clear. This is important in that if a patient is not able to communicate with those attending to him, his name and relevant information can readily be obtained from his wrist band. This minimizes the possibility of errors when hand written information is written on a bracelet which may subsequently be smudged or dissolved as a result of external fluids.

It can also be appreciated that the information can only be applied when sufficient lines of pressure are applied to the deformable layer 38. Generally this requires a credit card imprinter or writing on a hard surface. While the bracelet is being worn, it is extermely difficult to apply sufficient forces to the layer 38 to cause deformation. This is advantageous as it increases the security of the information on the bracelet.

Thus, there has been provided a wrist band assembly that fully satisfies the objects, aims and advantages set forth above. It is evident that many alternatives, modifications, and variations will be apparent to those skilled in the art. Accordingly, it is intended to embrace all such variations as fall within the spirit and broad scope of the appended claims.

What is claimed is:

1. A bracelet assembly for receiving thereon and for carrying identification information comprising:

an elongated flexible band with fastening means for locking the band in a closed loop fashion around a wearer's limb;

a transparent portion in the flexible band;

a protective cover layer removably affixed to the flexible band over the transparent portion;

a permanently deformable layer bonded directly to the transparent portion in the flexible band on the side thereof opposite the protective cover;

a colored base layer bonded to the permanently deformable layer so as to seal the permanently deformable layer between the base layer and the flexible band;

the permanently deformable layer being of contrasting color to the base layer and masking the base layer from view through the transparent portion;

the permanently deformable layer being permanently deformed by the application thereto of lines of pressure to render the base layer visible through the permanently deformable layer;

the desired identification information being received on and carried by the bracelet assembly by applying lines of pressure to one of the base layer and the protective cover and transmitting the same therefrom to the permanently deformable layer;

the identification information being visibly displayed through the transparent portion when the protective cover layer is removed.

2. The bracelet of claim 1 wherein the permanently deformable layer is made of polytetrafluoroethylene.

3. The bracelet assembly of claim 2 wherein the flexible band is made of nylon and a low density polyethylene.

4. The bracelet assembly of claim 1 wherein the fastening means comprises holes in the band, with two holes being in alignemnt when the band is in a closed loop fashion, and a locking fastener that passes through the two aligned holes.

5. The bracelet assembly of claim 4 wherein the locking fastener comprises a receiving socket and a tapered plug, the plug entering the receiving socket in a locking manner whereby it cannot be removed after insertion into the socket.

6. The bracelet assembly of claim 5 wherein the socket and plug are connected by a flexible tether.

7. The bracelet assembly of claim 1 wherein the lines of pressure are applied to the permanently deformable layer by means of a card having rigid raised characters therein which are pressed against the colored base layer of the bracelet assembly.

8. The bracelet assembly of claim 1 wherein the lines of pressure are applied to the protective cover layer and trasmitted to deform the permanently deformable layer.

* * * * *

UNITED STATES PATENT AND TRADEMARK OFFICE

CERTIFICATE OF CORRECTION

PATENT NO. : 4,783,917

DATED : November 15, 1988

INVENTOR(S) : Robert E. Smith, Thomas A. Johnson, Jr.

It is certified that error appears in the above-identified patent and that said Letters Patent is hereby corrected as shown below:

Column 3, line 66, the word "tap" should read -- tab --; column 6, line 55, the word "trasmitted" should read --transmitted --.

Signed and Sealed this

Twenty-eighth Day of March, 1989

*Attest:*

DONALD J. QUIGG

*Attesting Officer*

*Commissioner of Patents and Trademarks*